US005569040A

United States Patent [19]

Sumida

[11] Patent Number: 5,569,040

[45] Date of Patent: Oct. 29, 1996

[54] COMBINATION CONNECTOR

[75] Inventor: Tatsuya Sumida, Yokkaichi, Japan

[73] Assignee: Sumitomo Wiring Systems, Ltd., Yokkaichi, Japan

[21] Appl. No.: 992,474

[22] Filed: Dec. 17, 1992

[30] Foreign Application Priority Data

Dec. 27, 1991 [JP] Japan ..... 3-346966

[51] Int. Cl.[6] ..... H01R 13/62

[52] U.S. Cl. ..... 439/157; 439/540.1

[58] Field of Search ..... 439/540, 62, 59, 439/79, 372, 153, 157, 159, 160

[56] References Cited

U.S. PATENT DOCUMENTS

| | | | |
|---|---|---|---|
| 3,345,604 | 10/1967 | Henschen et al. . | |
| 4,666,325 | 5/1987 | Vantouroux . | |
| 4,780,090 | 10/1988 | Sugiyama et al. . | |
| 4,997,386 | 3/1991 | Kawachi et al. | 439/540 |
| 5,035,634 | 7/1991 | Hasircoglu et al. . | |
| 5,135,410 | 8/1992 | Kawase et al. | 439/157 |
| 5,174,785 | 12/1992 | Endo et al. | 439/157 |
| 5,184,961 | 2/1993 | Ramirez et al. | 439/540 |
| 5,201,665 | 4/1993 | McCardell, Jr. et al. | 439/157 |

FOREIGN PATENT DOCUMENTS

| | | |
|---|---|---|
| 0123590 | 10/1984 | European Pat. Off. . |
| 1517332 | 2/1968 | France . |
| 3-20880 | 2/1991 | Japan . |
| 2179506 | 3/1987 | United Kingdom . |

*Primary Examiner*—David L. Pirlot
*Attorney, Agent, or Firm*—Greenblum & Bernstein, P.L.C.

[57] ABSTRACT

A combination connector consists of: a first holding member for holding a plurality of female connectors, a second holding member for holding a plurality of male connectors and a lever rotatably mounted on the first holding member or the second holding member. The lever has cam grooves to be engaged with pins projecting from the first holding member or the second holding member. In this construction, the lever is rotated with the pin engaging the cam groove so as to engage the female connectors held by the first holding member and the male connectors held by the second holding member with each other and connect the first holding member and the second holding member with each other.

13 Claims, 4 Drawing Sheets

COMBINATION CONNECTOR

BACKGROUND OF THE INVENTION

1. Field of the Invention

The present invention relates to a combination connector formed by combining male and female connectors with each other with a plurality of female connectors, held by a holding member, engaged by a plurality of male connectors and more particularly to a connector preferably used to be set in an electronic unit for connecting with a wire harness mounted in a car body.

2. Description of the Related Art

In recent years, a car body is equipped with more and more electronic parts. Thus, a wire harness has more and more circuits. As a result, wire harnesses are increasingly connected with one connector. The more wire harnesses are mounted on one connector, the more a load to be applied to connectors increases in engaging the female connector and the male connector with each other, which causes a problem in operation. In addition, they are liable to be combined with each other incompletely. As a result, electric parts connected with the connector via the wire harness may not work.

The above-described problem occurs when a large number of wire harnesses are connected with one connector having many terminal-accommodating chambers. But if the number of wire harnesses to be connected with one connector is reduced, it is necessary to combine many male and female connectors with each other. As a result, the combining operation takes much time and labor. Further, it is necessary to provide a mechanism for holding male connectors and female connectors, respectively. Thus, the connector-holding construction is complicated and the connector-installing space increases. This is a problem in an electronic unit in which connectors are required to be intensively disposed.

This problem may be solved as follows: That is, a plurality of female connectors respectively, to be connected with a small number of wire harnesses respectively, held by a holding member, is simultaneously combined with a plurality of male connectors held by another holding member. In this manner, time and labor and space for combining male and female connectors with each other can be reduced.

An example of a combination connector formed by the above-described manner is disclosed in Japanese Utility Model No. 3-20880.

In the connector, a plurality of first connectors is held by a plurality of connector-holding portions formed by concaving a first connector cover and similarly, a plurality of second connectors is held by a plurality of connector-holding portions formed by concaving a second connector cover. A bolt is inserted from an opening formed through the first connector cover into a bolt-guiding portion formed on the second connector. In this manner, the first and second connectors are fixed to each other with a plurality of pairs of the first and second connectors engaged with each other.

In the above-described combination connector, male and female connectors are fixed to each other by means of the bolt. Therefore, tools such as a bolt, washer, push nut are required as tightening parts. As a result, manufacturing cost is high and in addition, parts management is required. In addition, since the tightening parts are made of metal, the combination connector thus formed is heavy.

Load is great in engaging female and male connectors with each other because the first and second connector covers holding a plurality of connectors are fixed to each other by means of the bolt. Thus, a device for fixing them to each other such as an impact wrench is required and thus a troublesome operation is required.

Shocks are imparted to parts mounted on a unit equipped with a computer and others due to the use of the impact wrench in connecting the female and male connectors with each other and thus shocks are transmitted from the connectors to the unit, which gives a bad influence on a soldered portion of the unit or elements of the computer.

In addition, the conventional combination connector is connected with many terminals and thus terminals are likely to be inserted into an erroneous terminal-accommodating chamber in assembling wire harness.

SUMMARY OF THE INVENTION

It is an object of the present invention to provide a combination connector comprising constituent male and female connectors manually combined with each other to prevent a shock from being generated by using the impact wrench.

It is another object of the present invention to provide a combination connector which is formed without using extra parts in order to facilitate parts management and reduce manufacturing cost and the weight thereof.

Further, it is another object of the present invention to provide a combination connector in which each connector is connected to a small number of terminals in order to prevent an erroneous insert of the terminal into the terminal chamber of the connector and increase a range of a freedom in design.

In accomplishing these and other objects, according to the present invention, there is provided a combination connector comprising: a first holding member for holding a plurality of female connectors; a second holding member for holding a plurality of male connectors; a lever rotatably mounted on the first holding member or the second holding member; a cam groove formed on the lever; and a pin, engaging the cam groove, formed on the first holding member or the second holding member. In this construction the lever is rotated with the pin engaging the cam groove so as to engage the female connectors held by the first holding member and the male connectors held by the second holding member with each other and connect the first holding member and the second holding member with each other.

Further, either the male connectors or the male connectors to be connected with a wire harness are removably inserted into the first or second holding member. Either the male connectors or the male connectors are connected with tab-like terminals projecting from a printed wiring board. The connector connecting the tab-like terminals have a plurality of tab-like terminal accommodating spaces divided by walls integrated with the holding member. Namely, the holding member serves as the connector housing and then a separate holding member is not required.

Preferably, the number of terminal-accommodating chambers to be formed inside the connector accommodating a terminal connected with a wire harness is small so as to reduce the number of wire harnesses to be installed on one connector. Since the connector accommodating the terminal connected with the wire harness is a separate piece, connectors adapted for electric current of a high intensity and a low intensity may be installed in one holding member according to a circuit.

The lever and the pin engaging the lever may be installed on the first holding member or the second holding member and the configurations thereof are not limited. Preferably, the lever is U-shaped and the upper and lower frames thereof are disposed outside the upper and lower frames of the first or second holding member, respectively and rotatably mounted on shafts projecting from the center of the upper and lower frames of the first or second holding member and the cam grooves are formed around the upper and lower shaft.

A provisional locking projection and a provisional concave (concavity) to be locked by the locking projection are formed on the first and second holding members, respectively or the second and first holding members, respectively. The provisional locking projection and the concave engage each other to connect the first holding member with second holding member at a provisional connective position on condition that the pin is inserted into the cam groove.

A locking portion for preventing the connectors from being removed from the holding member into which the connectors are removably inserted is formed on the holding member.

According to the above construction, the engagement between the male connectors which are held in the first holding member and the female connectors which are held in the second holding member is accomplished by the lever which is rotated. Therefore, only a small force is used in manual operation to combine the first and second holding members with each other. Since the lever and the pin are integral with the first and second holding members, an extra jig is not required in combining operation. Thus, no shock is generated in assembling the combination connector. Thus, the combination connector can be installed on an electronic unit without having a bad influence thereon.

Since the lever and the pin are integral with the holding member, no extra parts in combining the male and female connectors with each other is required to be provided. Thus, the operation for assembling the combination connector can be easily accomplished with a small number of parts, which contributes to the reduction of manufacturing cost. In addition, since the lever is made of resin which is light similarly to the holding member, the combination connector is light and no wide space is required in assembling the connector from parts.

Male and female connectors commercially available may be held by the first and second holding members. In addition, male and female connectors removed from the first and second holding member may be used to connect electric wires with each other and further, used as a composite connector according to a circuit by combining male and female connectors adapted for electric current of a high intensity and of a low intensity with each other.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
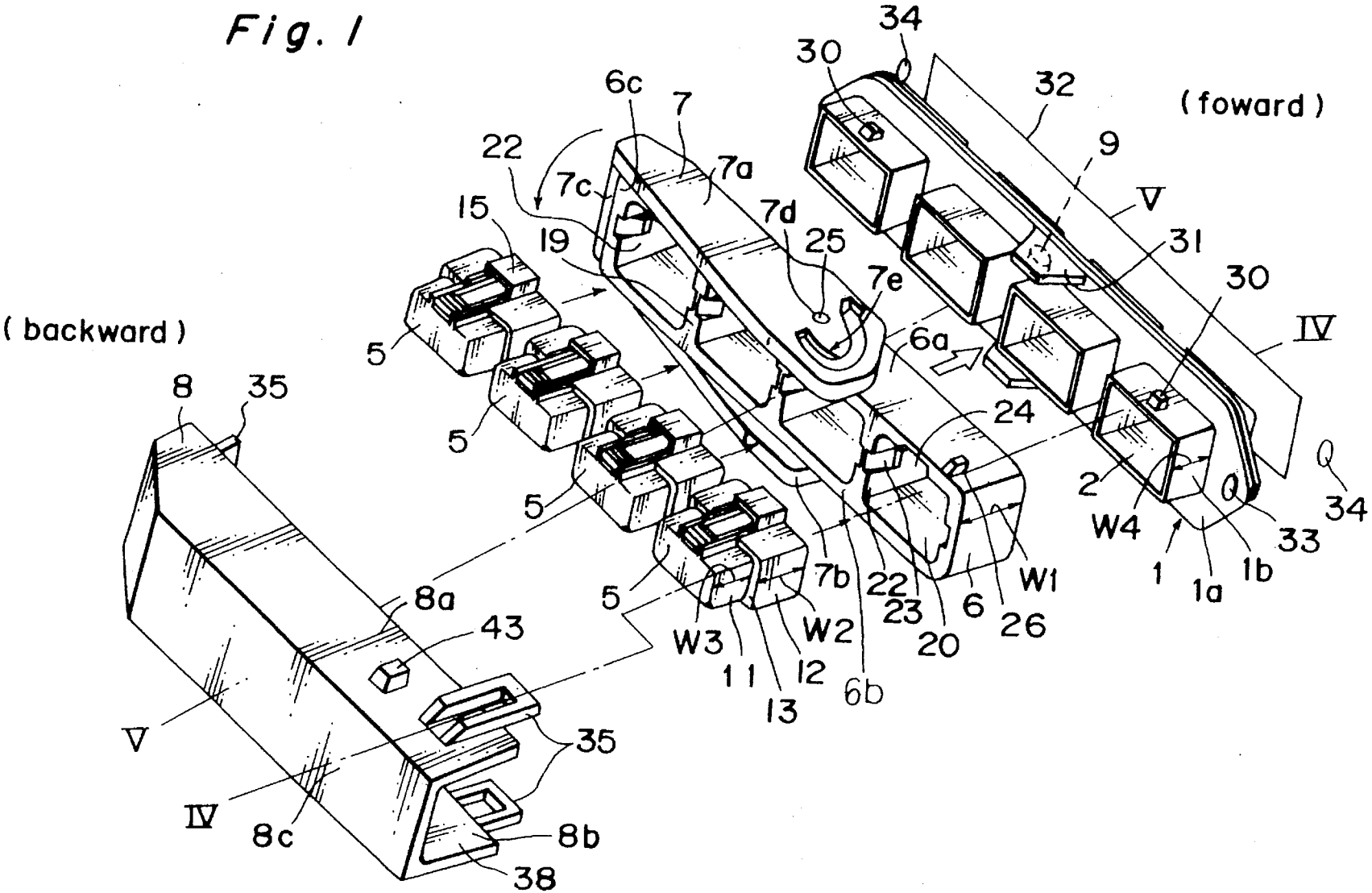
FIG. 1 is a perspective view showing an exploded connector according to an embodiment of the present invention.

Before the description of the present invention proceeds, it is to be noted that like parts are designated by like reference numerals throughout the accompanying drawings.

Referring now to FIGS. 1 through 5, an embodiment of the present invention will be described below.

Figure 2:
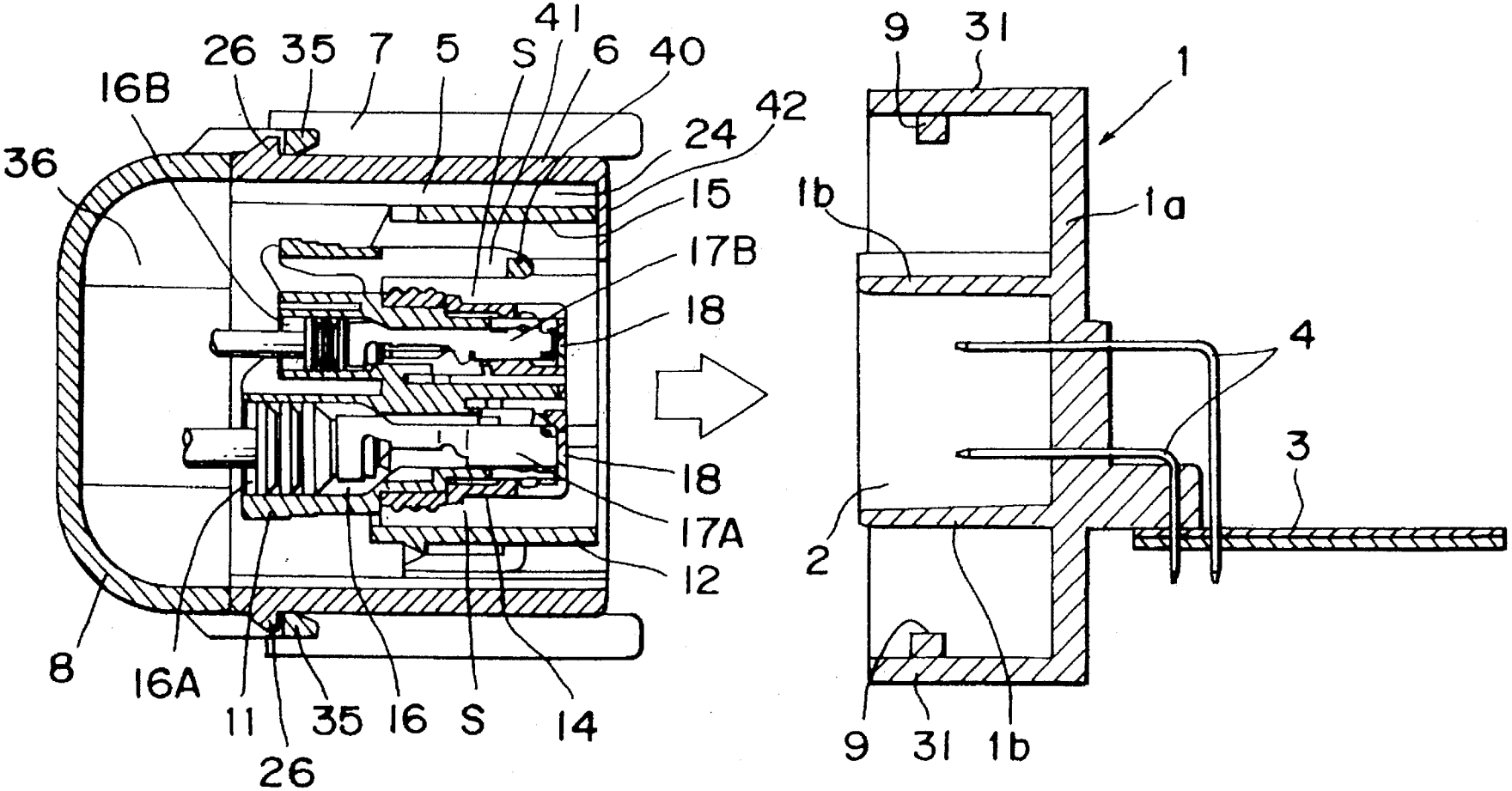
FIG. 2 is a sectional view showing a female connector and a cover installed on a holding member in the embodiment and the state of a male connector housing.

In the embodiment, a connector 5 accommodating a terminal connected with a wire harness is engaged by a connector 1 accommodating a terminal connected with a printed wiring board. In the latter, a plurality of terminal-accommodating spaces 2 (terminal-accommodating chamber) is formed on a male connector housing 1, and male tabs 4 projecting from a printed wiring board 3 are accommodated in each of the terminal-accommodating space 2 arranged in parallel with each other on the male connector housing 1 as shown in FIGS. 1 and 2. That is, in the embodiment, the male connector housing 1 serves as a holding member.

As shown in FIG. 1, female connectors 5 to be connected with the wire harness are held by a holding member 6. A lever 7 is installed on the holding member 6, and a cover 8 for preventing the female connectors 5 from slipping out of position is removably mounted on the holding member 6. A pin 9 projecting downward from the male connector housing 1 serving as the holding member is engaged by a cam groove **7*e* formed on the lever 7. Then, the lever 7 is rotated so as to insert a plurality of the female connectors 5 held by the holding member 6 into each terminal-accommodating space 2 of the male connector housing 1, and the male tab 4 is inserted into a female terminal 17A, 17B accommodated in each female connector 5 so as to connect the male tab 4 with the female terminal 17A, 17**B respectively.

Referring to FIG. 1 in particular, the construction of each member is described below in detail. The female connector 5 accommodates terminals each matching the intensity of electric current flowing through a circuit and comprises a smaller rectangular frame 11 and a larger rectangular frame 12. The terminals are inserted into the end opening portion of the frame 11. A locking stepped portion 13 formed in the periphery of the female connector 5 which is locked by an elastic locking strip 23 formed on the holding member 6. In this manner, each female connector 5 is held inside the holding member 6. The elastic locking strip 23 will be described later.

As shown in FIG. 2, a locking arm 40 projects backward from the front wall continuous with the frame 12. A locking opening 41 for locking the male connector housing 1 is formed on the locking arm 40. A U-shaped protecting wall 15 is formed above the locking opening 41. The frame 12 constitutes the outer wall of the female connector 5 and an inner frame 14 thereof is formed in continuation with the frame 11 with a male connector-engaging space (S) formed inside the frame 12.

A plurality of the terminal-accommodating chambers 16 is formed inside the frame 11 as well as the inner frame 14. As shown in FIG. 2, two terminal-accommodating chambers 16 are arranged in parallel with each other in upper and lower stages, respectively so as to connect four electric wires with each terminal. A terminal-accommodating chamber 16A formed on the lower stage is larger than the terminal-accommodating chamber 16B formed in the upper stage.

That is, the terminal-accommodating chamber 16A accommodates a terminal 17A adapted for electric current of a higher intensity and the terminal-accommodating chamber 16B accommodates a terminal 17B adapted for electric current of a lower intensity. The terminal-accommodating chambers 16A and 16B are opened on the wire-inserting side thereof and has a through-hole 18 formed on the connector-engaging side thereof so as to insert the male tab 4 thereinto.

Figure 3:
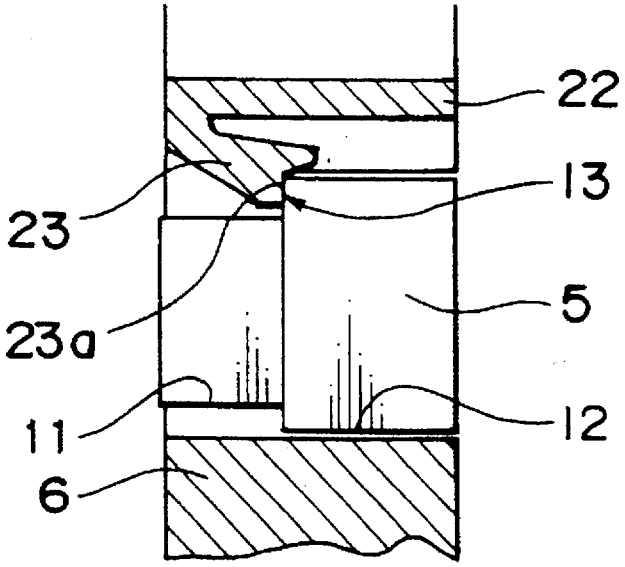
FIG. 3 is an enlarged sectional view showing principal portions in the state in which the female connector is installed on the holding member.

The holding member 6 for accommodating the four female connectors 5 is rectangular, i.e., the holding member 6 is long widthwise and is opened in its front and rear. The holding member 6 is partitioned by partitioning walls 19 formed widthwise at regular intervals so as to form four connector-holding chambers 20 in parallel with each other therein. As shown in FIG. 3 in particular, an elastic locking strip 23 projects downward or forward from a side wall 22 consisting of the partitioning wall 19 of each connector-holding chamber 20 or the outer frame of the holding member 6. A stepped portion 23*a* is formed on the end of the elastic locking strip 23. Pressing the female connector 5 forward into the holding member 6 as shown by arrows of FIG. 1, the frame 12 passes the elastic locking strip 23. Consequently, the locking step 13 disposed between the frame 11 and the frame 12 is locked by the stepped portion 23*a* of the elastic locking strip 23. In this manner, the female connector 5 can be prevented from slipping out from the holding member 6. In addition, a wall 42 is formed on the front of the holding member 6 so as to retain the connector 5 therein.

Each connector-holding chamber 20 has on the upper surface thereof a concave 24 into which the protection wall 15 projecting upward from the upper surface of the female connector 5 is inserted.

The length W1 of the holding member 6 is approximately equal to the sum of the length W2 of the frame 12 and the length W3 of the frame 11. In this manner, each female connector 5 can be completely accommodated inside each connector-holding chamber 20 of the holding member 6.

The lever 7 to be rotatably mounted on the holding member 6 is U-shaped. The upper and lower frames 7*a* and 7*b* of the lever 7 are disposed outside the upper and lower frames 6*a* and 6*b* of the holding member 6, respectively and a vertical frame 7*c* of the lever 7 disposed between the upper and lower frames 7*a* and 7*b* is disposed outside a side frame 6*c* (right or left) of the holding member 6. Two openings 7*d*, 7*d* are formed on the upper and lower frames 7*a* and 7*b* so as to rotatably insert shafts 25 projecting upward and downward from the center of the upper and lower frames 6*a* and 6*b* into the openings 7*d*, 7*d* respectively.

The cam grooves 7*e*, 7*e* approximately semicircular are formed in the periphery of the opening 7*d*, 7*d* formed on the upper frame 7*a* and lower frame 7*b* of the lever 7.

A projection 26 for locking the cover 8 is formed on the upper and lower surfaces of the holding member 6.

The male connector which engages the female connector 5 held by the holding member 6 is integrally formed on the male connector housing 1 serving as the holding member as described previously. That is, as shown in FIGS. 1 and 2, four rectangular frames 1*b*, integral with a flat vertical wall 1*a*, project backward therefrom at regular intervals to form the four terminal-accommodating space 2 each surrounded with a box-shaped housing which is opened in the rear and closed in the front and left and right.

Each of the four terminal-accommodating space 2 is inserted into the space (S) between the outer and inner frames of the frame 12 of the female connector 5 held inside each connector-holding chamber 20 of the holding member 6. The projection width W4 of each terminal-accommodating space 2 is approximately equal to the length W2 of the frame 12.

A provisional locking projection 30 is formed on the upper surface of each rectangular frame 1*b* so as to insert the provisional projection 30 into the locking opening 41 formed on the upper surface of each female connector 5.

A pin-mounting plate 31 is provided projecting backward from the center of the vertical wall 1*a* of the male connector housing 1. The pin 9 projects downward from the bottom surface of the pin-mounting plate 31 so that the pin 9 is removably inserted into the cam groove 7*e* of the lever 7.

The front of the vertical wall la is fixed to a unit which accommodates the printed wiring board 3. FIG. 1 shows only an opening hole 32 of the unit. A pair of opening holes 33 are formed on both sides of the vertical wall la so that the male connector housing 1 and the unit are fixed to each other by screws (not shown) which are inserted into the holes 33 and opening holes 34 formed on the unit.

As shown in FIG. 2, the male tabs 4 connected with the circuit of the printed wiring board 3 accommodated in the unit penetrate through the vertical wall 1*a*, thus projecting into each terminal-accommodating space 2. As described previously, each female connector 5 has four female terminals in this embodiment. Accordingly, four male tabs 4 (two male tabs 4 arranged in upper and lower stages, respectively) are inserted into each terminal-accommodating space 2. Needless to say, the number of the female terminals may be varied and thus that of the male tabs 4 to be connected therewith may be changed accordingly.

In order to prevent the female connector 5 held by the holding member 6 from slipping out therefrom, the cover 8 is mounted on the holding member 6. The cover 8 sectionally U-shaped comprises upper and lower frames 8*a* and 8*b*, and a rear frame 8*c* and is opened in the front thereof. A locking arm 35 projecting forward from the upper and lower frames 8*a* and 8*b*, respectively locks the projection 26 formed each on the upper and lower surfaces of the holding member 6. In this manner, the holding member 6 and the cover 8 are fixed to each other.

As shown in FIG. 2, a pressing portion 36 which is brought into contact with the upper and lower portions of the frame 12 of the female connector 5 projects from the inner surface of the rear frame 8*c* of the cover 8.

The cover 8 has an opening 38 at one end widthwise so as to take out an electric wire connected with each female connector 5 therefrom.

The method for combining the cover 8, the female connector 5, the holding member 6, and the male connector housing 1 with each other is described below.

First, each of the four female connectors 5 is inserted into each connector-holding chamber 20 of the holding member 6 so that each female connector 5 is locked by the elastic locking strip 23. Thereafter, the locking projection 26 is locked by the locking arm 35 so as to install the cover 8 on the rear surface of the holding member 6. As a result, the pressing portion 36 of the cover 8 contacts the rear surface of the female connector 5 as shown in FIG. 2, thus holding the female connector 5.

Figure 4:
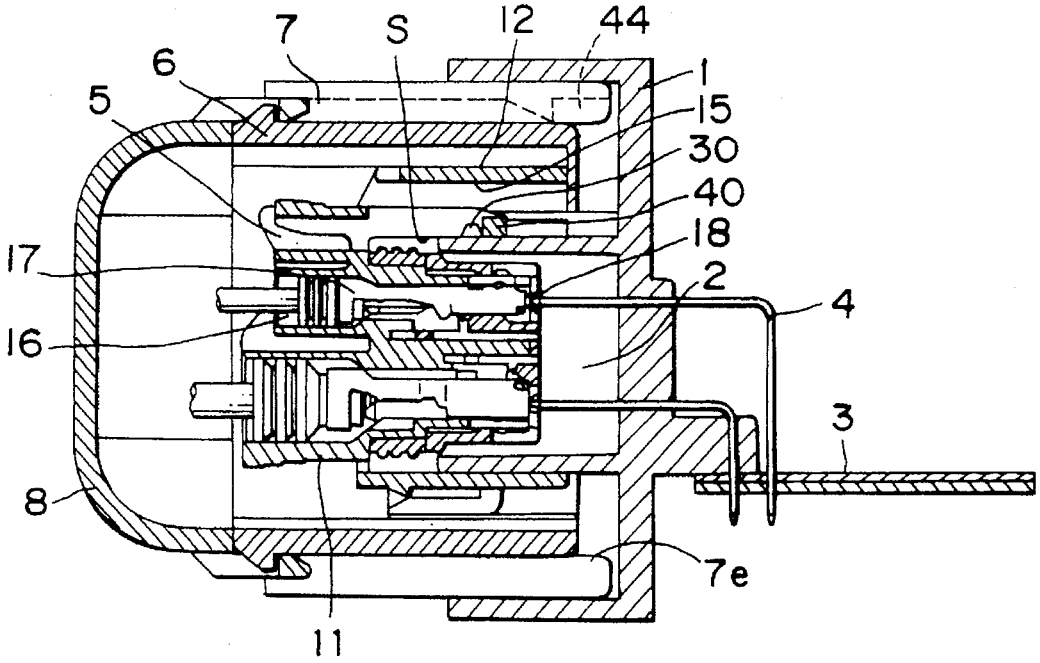
FIG. 4 is a sectional view taken along a line IV—IV of FIG. 1 at a provisional locking position in the embodiment.

Then, as shown in FIG. 4, the holding member 6 is moved toward the male connector housing 1 so as to insert each of the four terminal-accommodating space 2 into each rear opening of the holding member 6, insert the frame 1*b* composing the housing of each terminal-accommodating space 2 into the space (S) of each female connector 5, and lock the projection 30 by the locking opening 41 of the female connector 5. FIG. 4 shows a provisional connecting state in which the holding member 6 is engaged provisionally with the male connector housing 1. At the provisional position, the male tab 4 is disposed at the entrance of the through-hole 18 formed at the rear end of each female connector 5.

Figure 5:
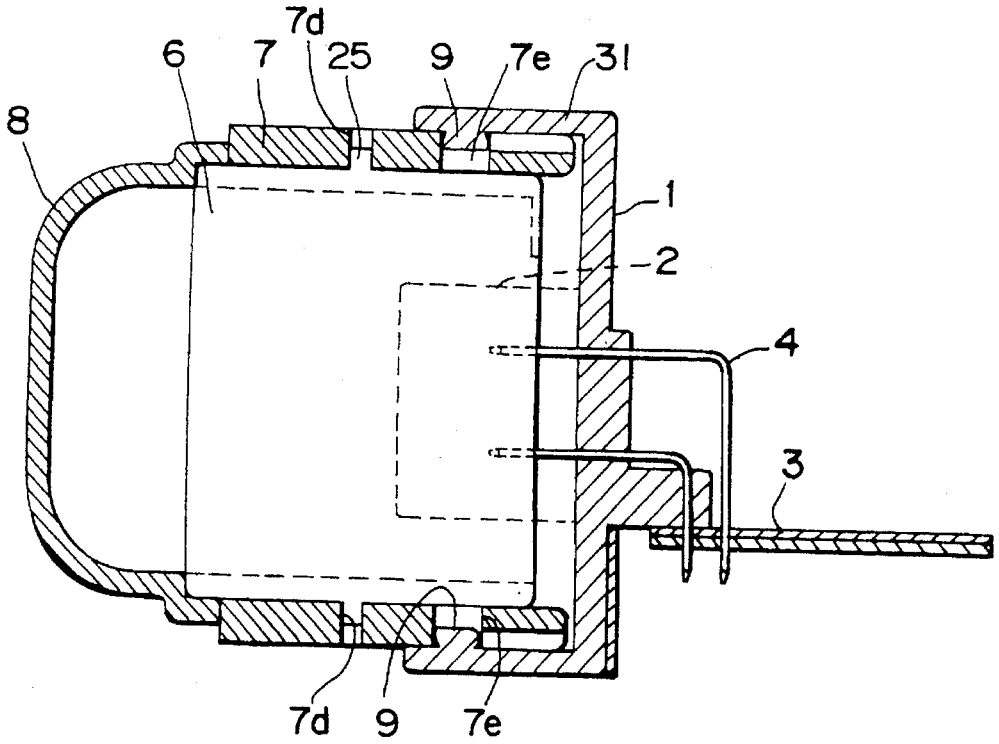
FIG. 5 is a sectional view taken along a line V—V of FIG. 1 at the provisional locking position in the embodiment.

In this condition, the pin 9 is inserted into the rear end of the cam groove 7*e* of the lever 7 installed on the holding member 6, as shown in FIG. 5.

Thereafter, the lever 7 is rotated in the direction shown by an arrow of FIG. 1. As a result, the pin 9 moves along the cam groove 7*e* and thus the holding member 6 is moved toward the male connector housing 1.

Then, the holding member 6 placed at the position as shown in FIG. 4 is moved forward as a result of the further rotation of the lever 7. The male tab 4 is inserted through the through-hole 18 of each female connector 5 and then into the female terminal 17. As a result, the female terminal 17 and the male tab 4 are electrically connected to each other. Consequently, the frame 12 of the female connector 5 engages the frame 1*b*.

Then, a locking stepped portion 44 formed on the inner surfaces of the lever 7 is locked by a locking projection 43 formed on the upper surface of the cover 8. As a result, the lever 7 is fixed to the cover 8.

The connector according to the present invention is not limited to the above-described embodiment, but may be embodied in various aspects. For example, the lever may be installed on the male connector housing and the pin may be mounted on the holding member. In the connector, formed by the engagement between a male connector and a female connector, to accommodate a terminal connected with an electric wire, the male connector may have a construction similar to that of the female connector so as to accommodate a plurality of male connectors and female connectors in a holding member, respectively and then connect the two holding members to each other by the lever.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A combination connector comprising:

a first holding member for holding a plurality of female connectors, said first holding member comprising partitioning walls formed at regular intervals so as to form a plurality of connector-holding chambers in said first holding member;

a second holding member for holding a plurality of male connectors, said second holding member comprising projecting walls so as to form a plurality of terminal-accommodating spaces in said second holding member;

a lever rotatably mounted on one of the first holding member or the second holding member;

a cam groove formed on the lever; and a downwardly projecting pin, engaging the cam groove, formed on the other of the first holding member or the second holding member; in which:

said cam groove is positioned below said pin and said lever is rotated with the pin engaging the cam groove so as to simultaneously engage said plurality of female connectors held by the first holding member and said plurality of male connectors held by the second holding member with each other and connect the first holding member and the second holding member with each other; and at least one said plurality of female connectors or said plurality of said male connectors comprises connectors which are individually and separately removably received in at least one of said first holding member or said second holding member.

2. A combination connector as defined in claim 1, wherein a locking portion for preventing the connectors from being removed from a respective holding member into which the connectors are removably inserted is formed on the holding member.

3. A combination connector as defined in claim 1, wherein said plurality of female connectors comprises connectors which are individually removably received in said first holding member and locked in said first holding member by an elastic locking strip having a stepped portion, prior to connecting said plurality of female and male connectors.

4. A combination connector as defined in claim 1, wherein said plurality of male connectors comprises connectors which are individually removably received in said second holding member and locked in said second holding member by an elastic locking strip having a stepped portion, prior to connecting said plurality of female and male connectors.

5. A combination connector as defined in claim 1 wherein said first or second holding member to which said lever is mounted comprises upper and lower frames; and said lever comprises upper and lower frames disposed outside said upper and lower frames of said holding member and a vertical frame disposed between said upper and lower frames of said lever.

6. A combination connector as defined in claim 1, wherein said cam groove formed on said lever is approximately semicircular.

7. A combination connector as defined in claim 1, wherein one of said first holding member or said second holding member is provided with a provisional locking projection, which is adapted to be received by a locking opening in the other of said first or said second holding member, so as to connect said first holding and said second holding member in a provisional connective position upon engaging said pin with said cam groove.

8. The combination connector of claim 1, wherein each said female connector can be completely accommodated in one of said connector holding chambers of said first holding member.

9. The combination connector of claim 1, wherein said connector holding chambers of said first holding member and said terminal accommodating spaces of said second holding member are constructed and arranged so as to register with each other.

10. The combination connector of claim 1, wherein said lever further comprises upper and lower frames disposed outside of said first holding member.

11. A combination connector as defined in claim 1, wherein at least one of the male connectors or connectors to be connected with a wire harness are removably inserted into one of the first or second holding member; and at least one of the male connectors or the connectors to be connected with a printed wiring board are formed on a connector housing a terminal-accommodating space, into which a tab projecting from the printed wiring board is inserted, said terminal-accommodating space being integral with the connector housing serves as a holding member for holding the tab.

12. A combination connector as defined in claim 11, wherein the lever is mounted on the holding member holding the connectors to be connected with the wire harness; and the pin engaging the cam groove of the lever is mounted on the connector housing serving as the holding member for holding the tab.

13. A combination connector as defined in claim 11, wherein a locking portion for preventing the connectors from being removed from a respective holding member into which the connectors are removably inserted is formed on the holding member.

* * * * *

UNITED STATES PATENT AND TRADEMARK OFFICE

CERTIFICATE OF CORRECTION

PATENT NO. : 5,569,040

DATED : October 29, 1996

INVENTOR(S) : Tatsuya SUMIDA

It is certified that error appears in the above-indentified patent and that said Letters Patent is hereby corrected as shown below:

At column 8, line 65 (claim 11, line 7), after "housing" insert ---forming---.

At column 9, line 1 (claim 11, line 10), after "housing" insert ---and---.

Signed and Sealed this

Eighth Day of July, 1997

Bruce Lehman

*Attest:*

BRUCE LEHMAN

*Attesting Officer*

*Commissioner of Patents and Trademarks*